United States Patent [19]

Berry et al.

[11] Patent Number: 4,714,084

[45] Date of Patent: Dec. 22, 1987

[54] METHOD AND APPARATUS FOR SIMULTANEOUSLY APPLYING AND BLENDING MAKE-UP IN ONE STEP

[76] Inventors: Craig Berry, 69 Sylvan Rd. N., Westport, Conn. 06880; Marc Bennett, 240 W. 15th St., New York, N.Y. 10011

[21] Appl. No.: 788,197

[22] Filed: Oct. 16, 1985

[51] Int. Cl.[4] ..... A45D 40/00; A45D 40/30

[52] U.S. Cl. ..... 132/88.7; 132/88.5; 401/190; 239/304; 239/306; 239/307

[58] Field of Search ..... 132/88.5, 88.7; 401/190, 44, 45, 46, 47; 239/304, 307, 306

[56] References Cited

U.S. PATENT DOCUMENTS

| | | | |
|---|---|---|---|
| 2,130,978 | 9/1938 | White | 401/15 |
| 2,427,033 | 9/1947 | Wahl | 401/44 X |
| 2,722,224 | 11/1955 | Blann | 132/88.5 |
| 2,941,696 | 6/1960 | Homm | 222/136 |
| 3,032,803 | 5/1962 | Walshauser | 401/190 |
| 3,130,734 | 4/1964 | Ellis et al. | 132/74.5 |
| 3,162,370 | 12/1964 | Moonan et al. | 239/304 |
| 3,236,457 | 2/1966 | Kennedy et al. | 239/304 |
| 3,335,961 | 8/1987 | Marraffino | 239/305 |
| 3,350,159 | 10/1967 | Rice, Jr. | 401/190 |
| 3,572,591 | 3/1971 | Brown | 401/190 X |
| 3,630,211 | 12/1971 | Seidler | 132/88.5 |
| 3,744,922 | 7/1973 | Fears | 401/190 |
| 3,850,656 | 11/1974 | Brown | 401/190 X |
| 3,951,157 | 4/1976 | Idec | 132/88.7 |

FOREIGN PATENT DOCUMENTS

| | | | |
|---|---|---|---|
| 87613 | 7/1959 | Denmark | 401/46 |
| 2331695 | 1/1974 | Fed. Rep. of Germany | 401/190 |
| 990028 | 9/1951 | France | 401/44 |
| 1353494 | 4/1964 | France . | |
| 2035138 | 6/1980 | United Kingdom . | |

*Primary Examiner*—Steven A. Bratlie

*Attorney, Agent, or Firm*—Pennie & Edmonds

[57] ABSTRACT

A method and apparatus for simultaneously applying and blending pigmented cosmetics is one step, wherein pressurized air is released from a container, is divided into one or more spray channels, and exits together with pigmented cosmetics through a directional shield onto an individual's skin. The pigmented cosmetics are mixed with the pressurized air by various means. In a preferred embodiment of the apparatus, a part or the entire directional shield can be removed, enabling changes in the size and shape of the area of skin where the pigmented cosmetics are deposited. For some embodiments of the apparatus, the colors and types of cosmetics used can be varied by switching interchangeable cartridges or canisters of cosmetics.

25 Claims, 19 Drawing Figures

METHOD AND APPARATUS FOR SIMULTANEOUSLY APPLYING AND BLENDING MAKE-UP IN ONE STEP

This invention relates to a method of applying and blending make-up in one step. A number of different embodiments of the apparatus to carry out the method of the invention are also disclosed.

BACKGROUND OF THE INVENTION

To achieve a smooth, attractive and professional application of pigmented cosmetics, it is necessary to carefully blend the edges of the applied cosmetic into the areas where the skin is exposed, and along the border between two different types or colors of cosmetics. For example, two or more shades of eye shadow are commonly applied together, and then blended to carefully merge one color into the other without distinct demarcation lines. Similarly, blush is often applied to the cheek bones in connection with a highlighter and contouring color. Since the purpose of the highlighter and contour are to shape and define the structure of the cheeks rather than decorate them with distinct shades of color, it is often essential to blend all of these colors so that discrete sections of color are not discernable.

The conventional way of applying and blending make-up involves at least two steps. First, two or more types or colors of make-up are separately applied where desired, then these different spots of color are blended. The process may be repeated several times in order to complete one make-up session. Many different types of devices are known in the art for accomplishing both the application step and the blending step.

Applicators for eye make-up are myriad and include brushes, fingers, and sponge tip applicators; examples of the latter include Seidler, U.S. Pat. No. 3,630,211 and Idec, 3,951,157. Blushes, rouges and other types of pigmented cosmetics are similarly applied. Despite the diversity of applicators, all of them will deposit the pigmented cosmetic as a discrete stripe or spot. After much practice, a person may be able to vary the pressure or stroke in their application and thereby decrease the amount of make-up applied in any one location. However, even a skilled cosmetologist is unable to apply cosmetics without further blending using fingers, brushes, sponges, etc., after the initial application, and certainly would not be able to simultaneously apply and blend two or more colors or types of cosmetics in one step.

The present invention overcomes the above difficulties and makes it possible to both apply and blend pigmented cosmetics by spraying one or more colors and/or types of cosmetic through a directional shield, thus depositing the cosmetics on the skin in the desired depth and shape. Other attempts have been made to spray on pigmented cosmetics, but these methods lack the precision required to blend facial cosmetics, which is possible using the apparatus and method of the present invention. In addition, the prior art methods would be not be adaptable for use in the delicate eye area.

Blann, U.S. Pat. No. 2,722,224 discloses a dispenser for fingernail treating liquid. The apparatus disclosed in that patent requires that a nail be inserted into a mask or shield, and is unadaptable for use in applying face make-up. Ellis et al., U.S. Pat. No. 3,130,734, is another example of a nail polish sprayer. In column 2, lines 22–25, the stencil end of the invention is described as formed of a pliable, flexible material, such as plastic, and is adaptable to expand when forced against a fingernail to conform to the nail. Any stencil which requires the application of force to the skin cannot be used in the eye area.

Unlike the above fingernail polish sprayers, applying make-up by air brushing does not require force; however, air brushing has a number of other disadvantages. One disadvantage is that the air brush method is adaptable only to applying one color or type of cosmetic to a large area, for example, applying foundation to the face. Also, air brushing is only readily available in a professional setting, e.g., fashion shows, since it requires large tanks of pressurized air. Air brushing also lacks the precision to direct color within carefully delineated areas. The present invention overcomes the aforementioned disadvantages and provides an individual with the means to achieve professional-looking make-up in a one-step method.

BRIEF SUMMARY OF THE INVENTION

In the present invention, a method and an apparatus for simultaneously applying and blending pigmented cosmetics in a one-step procedure is disclosed, wherein pressurized air is released from a container, is divided into one or more spray channels and exits together with pigmented cosmetics through a directional shield onto an individual's skin. Pigmented cosmetics are premixed with pressurized air or are mixed with the pressurized air as it passes through one or more spray channels by means of a number of different devices, as illustrated in the detailed description. The directional shield directs the spray streams in exactly the concentration, shape and location desired, including the overlap of two spray streams in accordance with particular constructions. In this manner, one or more colors and/or types of make-up can be instantly applied and blended, i.e., the colors will be graduated from light to dark or vary in thickness as directed by the apparatus of the invention. When two or more colors or types of make-up are applied using the method and apparatuses of the invention, the two colors or types of make-up will be instantly applied, blended and, if desired, mixed.

In a preferred embodiment of the apparatus, the directional shield can be removed, permitting changes in the size and shape of the area of skin where the pigmented cosmetics are deposited to be made. For some embodiments of the apparatus used, the colors and types of cosmetics used can be varied by switching interchangeable cartridges or canisters of cosmetics.

These features and the various embodiments of the method and apparatus for simultaneously applying and blending make-up in one step will become apparent from the following detailed description and from the drawings showing preferred embodiments of the apparatus and the method of its use.

DETAILED DESCRIPTION OF PREFERRED EMBODIMENTS

Figure 1:
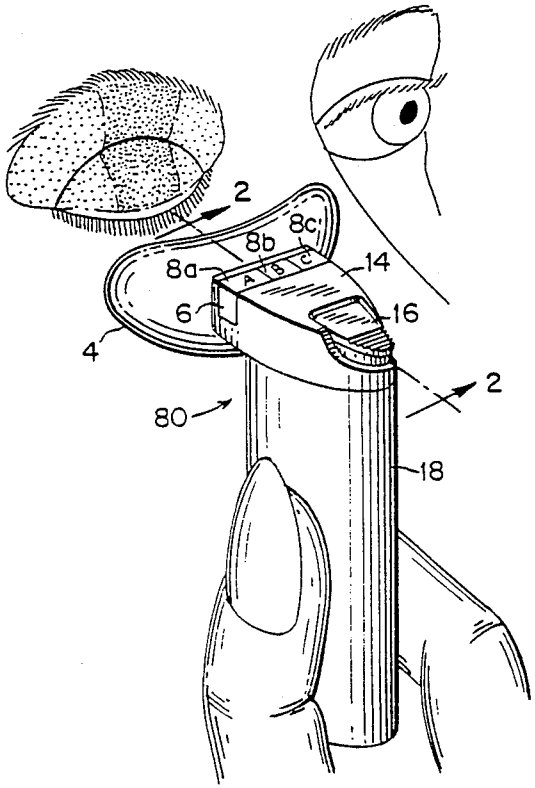
FIG. 1 is a perspective view of a preferred embodiment of the apparatus, as it is withdrawn, after simultaneously applying and blending make-up to an eyelid.

Referring to the drawings, FIG. 1 shows one embodiment of the apparatus, as it is being withdrawn after simultaneously applying and blending eyeshadow to an eyelid. FIG. 1 also shows the exterior configuration of apparatus 80. Directional shield 4 is shaped to conform to the general pattern of make-up to be applied to the eyelid. Directional shield 4 can be molded together with holder section 14. Alternatively, directional shield 4 can be constructed so that it can be removed from holder section 14 and rotated or switched with another directional shield. It is desirable to rotate the shield in order that the same pattern of cosmetics can be bilaterally applied. Completely removing the shield and replacing it with another shield of alternative shape permits different designs and patterns of make-up application. Shields can also be shaped in forms to be used elsewhere on the body such as the cheekbone or arm.

FIG. 1 also shows cartridge holder 6 divided into cartridge chambers 8*a*, 8*b*, 8*c*. In this particular embodiment, cartridge holder 6 can be slid out from holder section 14 and replaced with another cartridge holder. The three cartridge chambers 8*a*, 8*b*, 8*c* can contain the same or different colors or types of cosmetics. Trigger 16 extends from holder section 14 and is the means for releasing the pressurized air from canister 18, thereby permitting the operation of the apparatus.

Figure 2:
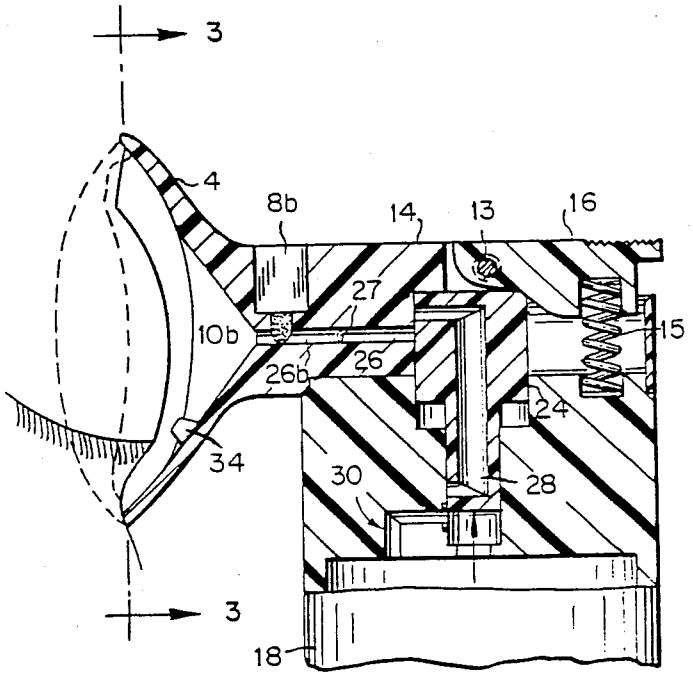
FIG. 2 is an enlarged, fragmentary, sectional view of the apparatus taken substantially along line 2—2 of FIG. 1, showing the apparatus positioned against an eyelid prior to actuation of the spray mechanism.

FIG. 2 shows the cross section of the upper portion of apparatus 80 as it is pressed against an eyelid. Directional shield 4 is shown pressed against the eyelid, blocking out an area for application of cosmetics. Eyelid damper 34 encourages a person to close their eyelids and keep them closed. Eyelid damper 34 also protects the eyelashes and eyes from pigmented cosmetics during spraying by checking the spray drift.

Figure 3:
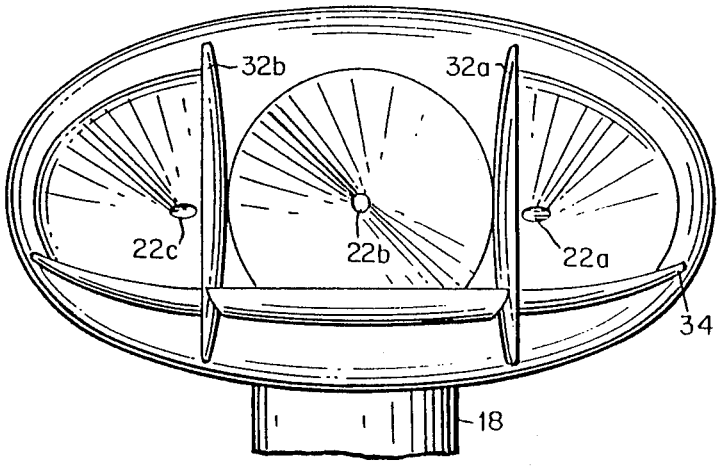
FIG. 3 is an enlarged, plan view of the apparatus taken substantially along line 3—3 of FIG. 2.

FIG. 3 shows a plan view of directional shield 4, which in this embodiment can apply up to three colors or types of pigmented cosmetics. The approximate pattern of spray jets as they emerge from spray nozzles 22*a*, 22*b*, 22*c* is shown in phantom. Stencil walls 32*a* and 32*b*, the outer rim of directional shield 4 and eyelid damper 34 all serve to direct and define the pattern of the spray jets after they emerge from spray nozzles 22*a*–*c*.

Figure 4:
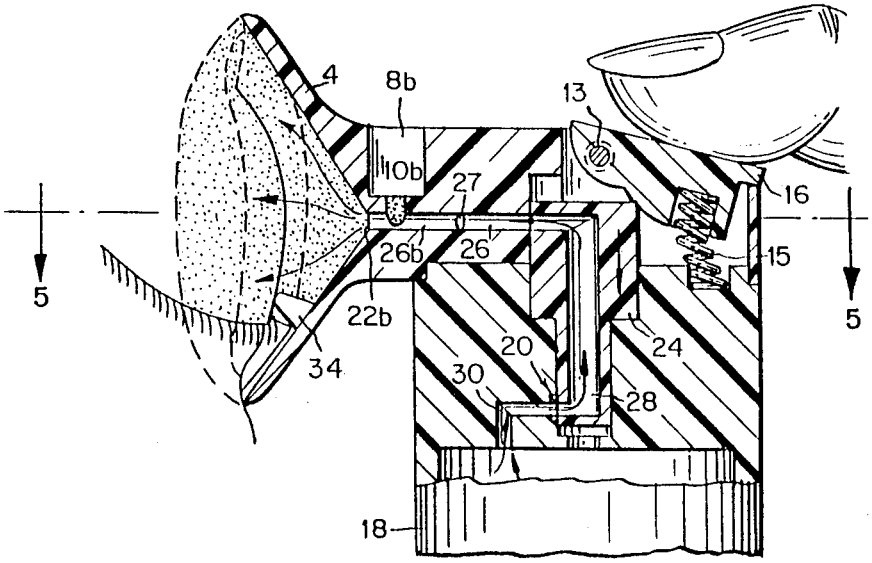
FIG. 4 is an enlarged, fragmentary, sectional view of the apparatus taken substantially along line 2—2 of FIG. 1 after the spray mechanism has been actuated.

FIG. 4 shows the same cross-sectional view as FIG. 2, however this view illustrates apparatus 80 in operation. When trigger 16 is pressed, trigger 16 will depress plunger valve 24, thereby opening a series of channels connecting canister 18, containing pressurized air, to spray nozzle 22*b*. The pressurized air spray passes through porous cartridge 10*b*, which is saturated with pigmented cosmetics. A portion of the pigmented cosmetics contained in porous cartridge 10*b* is atomized by the pressurized air passing through cartridge tip 10*b* and is then deposited on an eyelid as shown.

In the particular embodiment illustrated in FIG. 4, trigger 16 is connected to holder section 14 by means of pivot screw 13 and spring 15. When trigger 16 is depressed, trigger 16 depresses plunger valve 24 so that channels 30, 28, and 26 are all aligned, allowing the pressurized air stored in canister 18 to flow freely through these channels. When plunger valve 24 is completely depressed, pressurized air from canister 18 can pass through canister channel 30 into valve channel 28. Leakage of air, as it moves from canister channel 30 to valve channel 28, is prevented by ring seal 20. Ring seal 20 surrounds the connection between canister channel 30 and valve channel 28 when plunger valve 24 is fully depressed. The amount of air released is metered by any of the means well known in the art. Pressurized air rising through valve channel 28 will next flow through holder channel 26 to holder channel 26*b* and exit at spray orifice 22*b*. Holder channel 26 divides at branch point 27 into three channels, 26*a*, 26*b*, and 26*c*, in the illustrated embodiment. Other patterns of channels can be designed as desired.

Holder channel 26*b* ends in spray nozzle 22*b*. Spray nozzle 22*b* has square configuration, which permits the spray to exit in a diffuse pattern. FIG. 4 illustrates how the diffuse pattern of spray is directed onto the eyelid in the desired pattern and desired concentration by directional shield 4 as further defined by eyelid damper 34.

Figure 5:
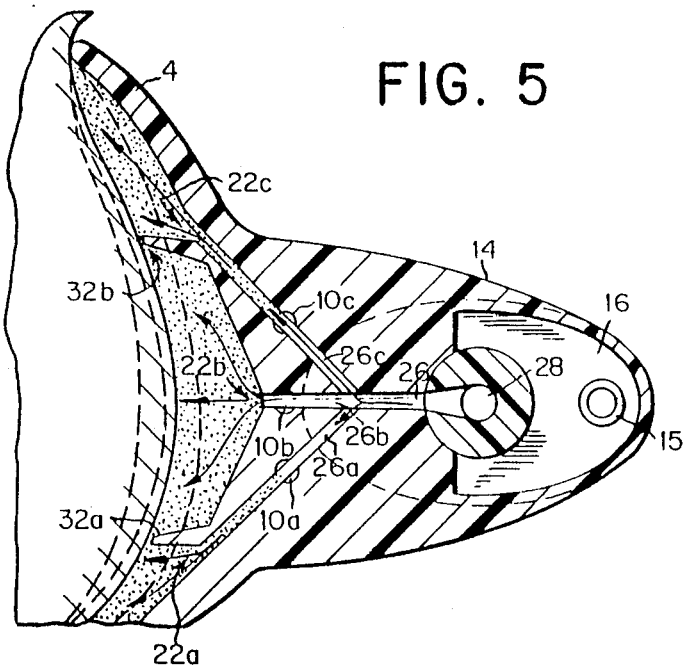
FIG. 5 is an enlarged, fragmentary, sectional view of the apparatus taken substantially along line 5—5 of FIG. 4, showing the flow of the spray during operation.

FIG. 5 illustrates a cross section of holder channel 26 while the apparatus is in operation and also demonstrates the method of the present invention. The arrows in FIG. 5 show the path of the pressurized air as it travels through holder channel 26. At branch point 27, the spray is divided as holder channel 26 splits into holder channels 26*a*, 26*b* and 26*c*. As the pressurized air passes through holder channels 26a, 26b, and 26c, it will pick up pigmented cosmetics from each of porous cartridges 10a, 10b and 10c. The mixtures of pigmented cosmetics and pressurized air emerge respectively from spray nozzles 22a, 22b and 22c. As the pigmented cosmetics and pressurized air spray mixtures emerge from spray nozzles 22a–c, they are directed by the directional shield 4 and stencil walls 32a and 32b onto the eyelid. The concentration of the pigmented cosmetics deposited decreases gradually away from the center portion of the eyelid directly opposite an individual spray nozzle, thus blending the pigmented cosmetics on the eyelid. Depending on the presence or absence of and the size or configuration of the stencil walls in a particular apparatus, there may be overlap between the sprays of pigmented cosmetics issuing from the nozzles.

For the particular embodiment disclosed in FIGS. 1 to 5, it may be desirable to construct a lid to fit over directional shield 4 to prevent evaporation of pigmented cosmetics from porous cartridges 10a, 10b and 10c in those instances when the pigmented cosmetics are used in liquid forms.

Figure 6:
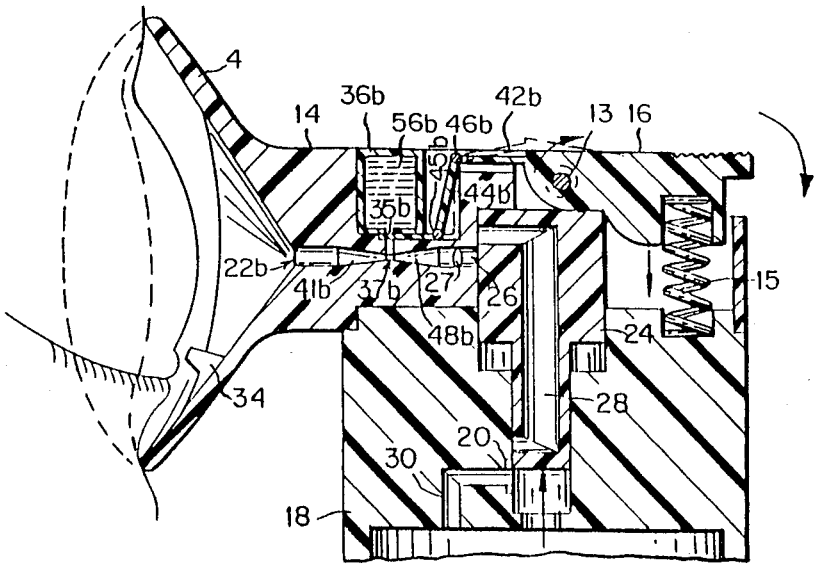
FIG. 6 is an enlarged, fragmentary, sectional view of another embodiment of the apparatus of this invention.

FIG. 6 shows an alternative embodiment for the apparatus of the present invention. In this embodiment, pigmented cosmetics 56b are stored in reservoir 36b in holder section 14. Depressing trigger 16 will lift trigger arm 42b, which is molded as part of trigger 16. Trigger arm 42b is connected with slide arm 44b by slide/arm trigger arm screw 46b. Slide arm 44b is connected to slide closure 48b by slide closure/slide arm screw 45b. The depression of trigger 16 moves the entire mechanism of trigger arm 42b, slide arm 44b, and slide closure 48b along the phantom lines of FIG. 6, thereby pulling slide closure 48b away from the reservoir opening 35b. Once slide closure 48b is thus displaced, pigmented cosmetics 56b will flow into reservoir exit channel 38b to reservoir outlet 37b.

Reservoir outlet 37b intersects with holder tunnel channel 41b. Holder tunnel channel 41b gradually narrows from each end, reaching its smallest width at the point where it intersects with reservoir outlet 37b. This construction creates a Venturi tunnel effect, thus there is a slight vacuum at the point of intersection, drawing pigmented cosmetics 56b into holder tunnel channel 41b, where pigmented cosmetics 56b will mix together with the pressurized air, also released when trigger 16 is depressed. The mixture of pigmented cosmetics and pressurized air will then exit through spray nozzle 22b as in the previously described embodiment. As previously discussed, the quantity of air released is metered by any of a number of well-known methods in the embodiment illustrated in FIG. 6 and in the embodiments described below.

The preferred pressure of the pressurized air ranges from 10 p.s.i. to 50 p.s.i. in one embodiment of the invention; in a preferred embodiment, the pressure of the pressurized air ranges from 20 p.s.i. to 40 p.s.i.

Figure 7:
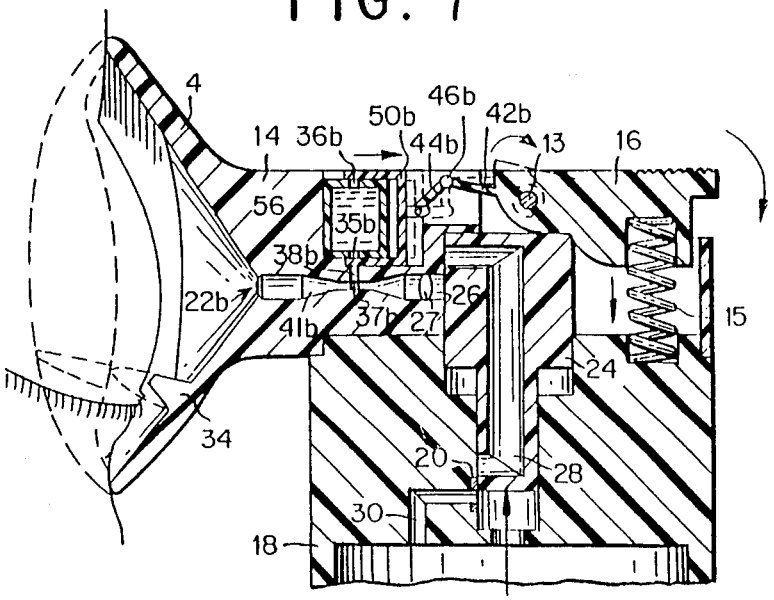
FIG. 7 is an enlarged, fragmentary, sectional view of another embodiment of the apparatus of the present invention.

FIG. 7 shows an embodiment of the apparatus of this invention similar to the apparatus shown in FIG. 6 except as to the details of the trigger mechanism opening reservoir 36b. In place of slide closure 48b shown in FIG. 6, frame slide closure 50b opens and shuts reservoir opening 35b in FIG. 7.

Figure 8:
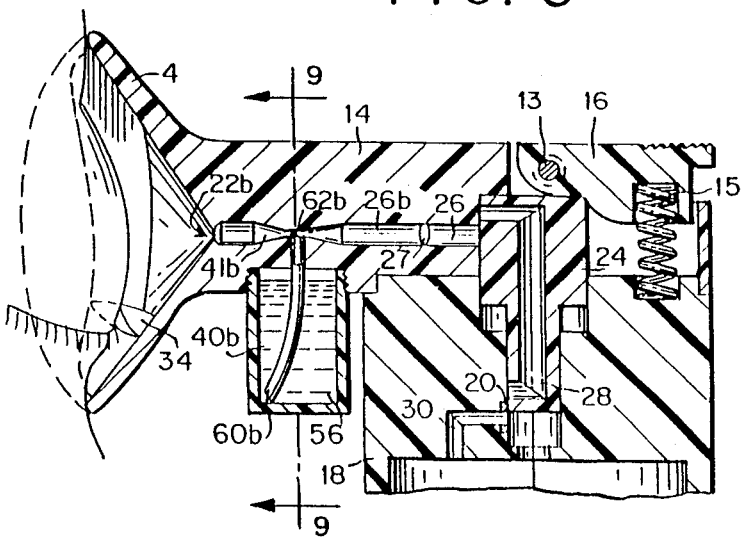
FIG. 8 is an enlarged, fragmentary, sectional view of another embodiment of the apparatus of the present invention.
Figure 9:
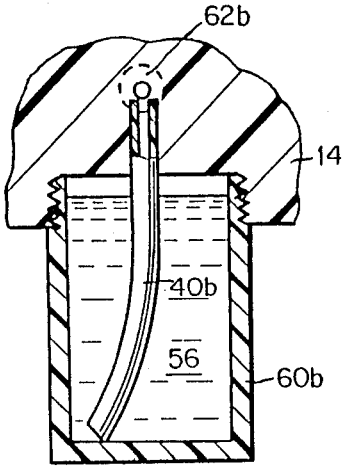
FIG. 9 is an enlarged, fragmentary, sectional view of one chamber containing pigmented cosmetic taken substantially along 9—9 of FIG. 8.

Reservoir 60b is attached to the bottom portion of holder section 14 in another embodiment of the apparatus, which is shown in FIG. 8. Reservoir tube 40b intersects with holder tunnel channel 41b at reservoir/tunnel intersection 62b; the other end of reservoir tube 40b opens into pigmented cosmetics 56b held within reservoir 60b. In this version of the apparatus, the vacuum created by the Venturi tunnel effect at reservoir/tunnel intersection 62b draws the pigmented cosmetics up into holder tunnel channel 41b, where it mixes with pressurized air released when trigger 16 is actuated. FIG. 9 shows a cross section of reservoir 60b and reservoir tube 40b.

Rather than mix pigmented cosmetics with pressurized air after the pressurized air has been released from canister 18, the pigmented cosmetics and pressurized air can be mixed and stored together as illustrated in FIGS. 10–13. The embodiment of the apparatus shown in FIGS. 10 and 11 consists of canister 52, which in this particular embodiment is divided into three chambers, 68a, 68b, and 68c. Chambers 68a, 68b and 68c containing respectively, pressurized air and pigmented cosmetic mixtures 58a, 58b, and 58c.

Figure 10:
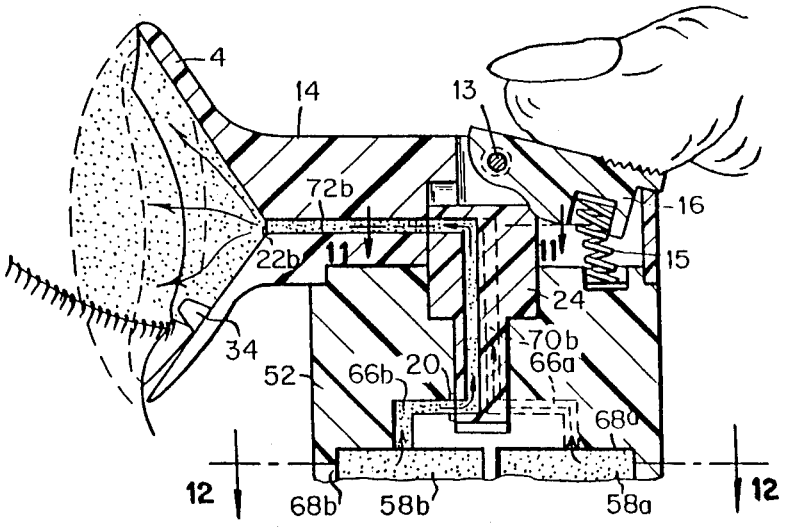
FIG. 10 is an enlarged, fragmentary, sectional view of a further embodiment of the apparatus of the present invention.

As illustrated in FIG. 10, when trigger 16 is depressed, plunger valve 24 is pushed down, completing the passage between canister channel 66b to valve channel 70b to holder channel 72b, allowing the pressurized air and cosmetics mixture 58b in chamber 68b to move through the completed passage and exit through spray nozzle 22b.

Figure 11:
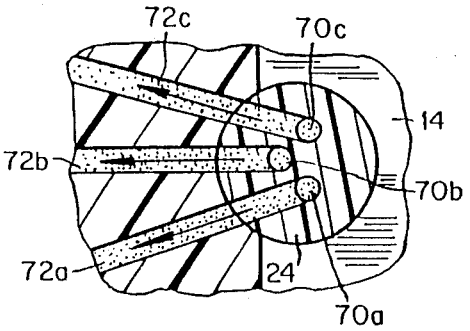
FIG. 11 is an enlarged, fragmentary, sectional view of the pressurized air channels taken substantially along line 11—11 of FIG. 10.

FIG. 11 is a view of the three valve channels 70a, 70b and 70c as they make a 90° turn to connect, respectively, with holder channels 72a, 72b and 72c.

Figure 12:
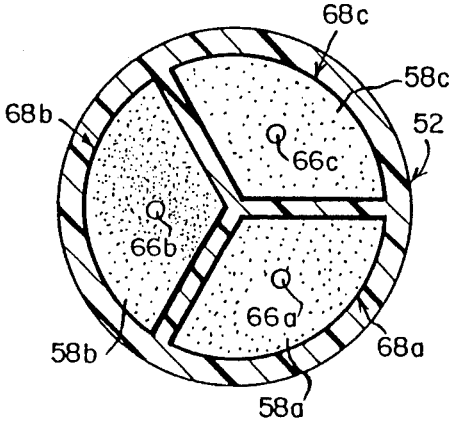
FIG. 12 is an enlarged, sectional view of the canister of the apparatus taken substantially along line 12—12 of FIG. 10.

A cross section of canister 52 is shown in FIG. 12. Canister 52 in this particular embodiment is divided into three chamber 68a, 68b and 68c, holding respectively pressurized air and pigmented cosmetics mixtures 58a, 58b and 58c. FIG. 12 also shows a cross section of canister channels 66a, 66b and 66c.

Figure 13:
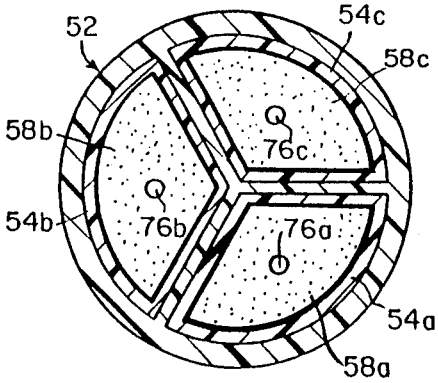
FIG. 13 is an enlarged, sectional view of the canister of an additional embodiment of the apparatus.

In another embodiment of the apparatus of the present invention, illustrated in FIG. 13, individual canisters, 54a, 54b and 54c are placed within canister 52. Each individual canister, 54a, 54b and 54c, is filled, respectively, with pressurized air and pigmented cosmetic mixtures 58a, 58b, 58c.

The two embodiments of the apparatus disclosed in FIGS. 10–13 can be constructed so that the canister 52 or individual canisters, 54a–c, can be disengaged from holder section 14 and interchanged with replacement canisters. The ability to switch the pigmented cosmetics containers in this and other embodiments of the apparatus, make it possible to both replenish the supply of cosmetics and to use one apparatus to apply a number of different color or type patterns of cosmetics.

Figure 14:
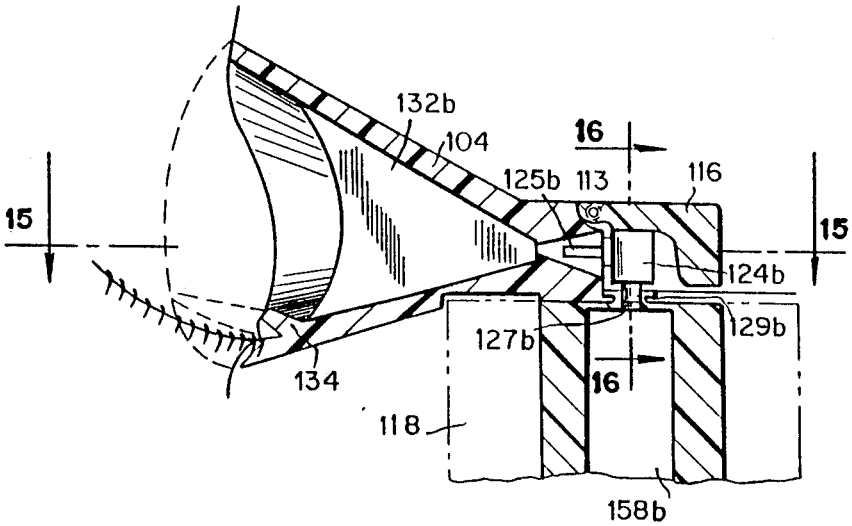
FIG. 14 is an enlarged, fragmentary, sectional view of a further embodiment of the apparatus of the present invention.

In the embodiment of the apparatus of the present invention shown in FIG. 14, individual canister 158b is held within outer canister 118. Canister 118 pivots relative to directional holder 104. Individual canister 158b is connected to valve stem 127b. Valve stem 127b is aligned with nozzle stem 129b. Nozzle stem 129b is attached to nozzle 124. Nozzle 124 is depressed when trigger 116 is depressed, consequently, the pressurized air and pigmented cosmetic mixture contained in individual canister 158b is released. The pressurized air and pigmented cosmetic mixture will exit through nozzle extension 125 and subsequently through directional holder section 104 before reaching the eyelid where the make-up is to be applied. The path of the pressurized air and pigmented cosmetic mixture as it exits from nozzle 124b will be deflected by stencil wall 132b and the walls of directional holder section 104.

As in the previous examples of the apparatus, eyelid damper 134 is molded as part of directional holder 104.

Figure 15:
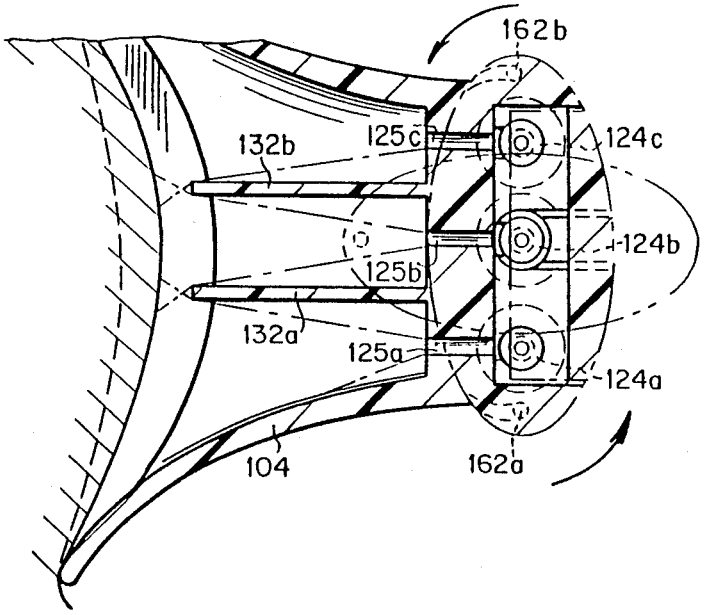
FIG. 15 is an enlarged, fragmentary, sectional view of the apparatus taken substantially along line 15—15 of FIG. 14.
Figure 16:
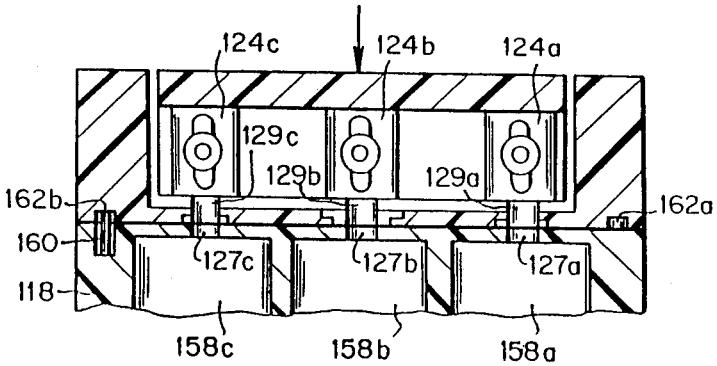
FIG. 16 is an enlarged, fragmentary, sectional view of the apparatus taken substantially along line 16—16 of FIG. 14.

FIGS. 15 and 16 show additional views of the embodiment of the apparatus disclosed in FIG. 14, in which three individual canisters 158*a*, 158*b* and 158*c* are aligned with three individual nozzles, respectively, 124*a*, 124*b* and 124*c*. The phantom lines in FIG. 15 illustrate how canister 118 can turn relative to directional holder 104. When canister 118 has been turned 180° in the direction indicated by the arrows in FIG. 15, peg 160 will snap into recess 162*a*, keeping directional holder section 104 in the proper alignment with canister 118. After the 180° pivot of canister 118, individual canisters 158*a*, 158*b* and 158*c* would then align with, respectively, individual nozzles 124*c*, 124*b* and 124*a*. This particular embodiment of the apparatus can thus be used to apply simultaneously three colors or types of make-up in a pattern, e.g., which is bilaterally symmetrical. The apparatus could also be constructed to apply two, four, or more colors or types of cosmetics in a bilaterally symmetrical pattern.

Figure 17:
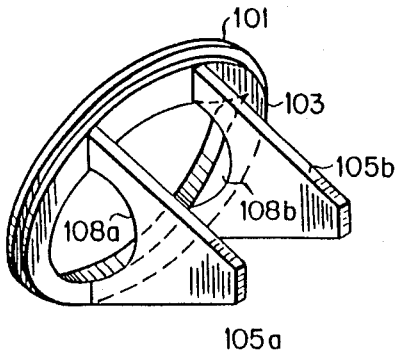
FIG. 17 is a perspective view of a stencil to be used as part of a preferred embodiment of the apparatus.
Figure 18:
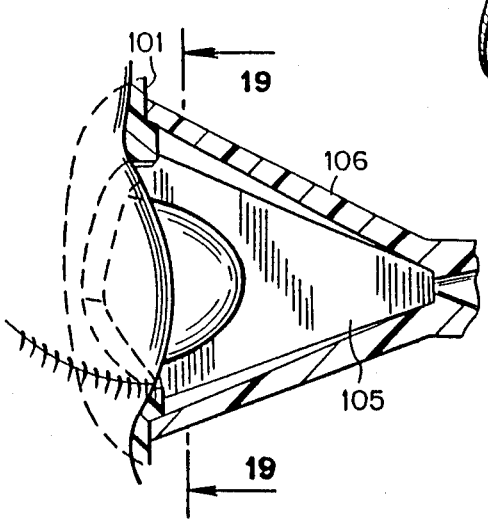
FIG. 18 is an enlarged, fragmentary, sectional view of the holder section of an embodiment of the apparatus with the removable stencil in place within the holder section.
Figure 19:
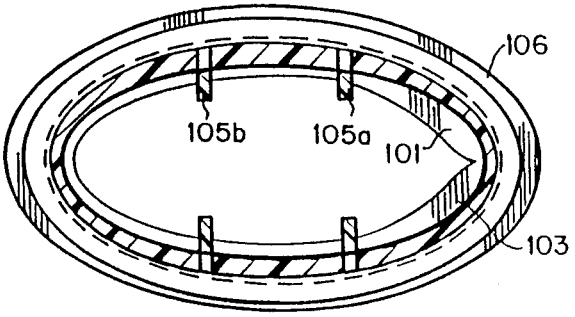
FIG. 19 is an enlarged, fragmentary, sectional view of the apparatus taken substantially along line 19—19 of FIG. 18.

Stencil 101 is disclosed in FIG. 17. Stencil 101 includes template section 103, stencil walls 105*a* and 105*b*, and fits inside directional holder 106 as shown in FIGS. 18 and 19. Directional holder 106 would be constructed without stencil walls in the embodiment of the apparatus of the invention which employs stencil 101, or any other stencil that incorporates stencil walls to direct the location and shape of the pressurized air and pigmented cosmetic sprays to be deposited on the skin. U-shaped edge 108*a* of stencil wall 105*a* and U-shaped edge 108*b* of stencil wall 105*b* permits adjacent pressurized air and pigmented cosmetic sprays to mix in the volume defined by U-shaped edges 108*a* and 108*b*. Different stencils can be used to alter the pattern of spray deposition. In the preferred embodiment disclosed in FIG. 17–19, or other embodiments of the apparatus employing a stencil as part of the directional shield, stencil 101 would be manufactured from a malleable material, such as a rubber-like substance, and directional holder 106 would be manufactured from a rigid material.

The above embodiments of the apparatus of the invention and other embodiments incorporating changes in details of the construction, combination, or arrangements of parts can be used to simultaneously apply and blend make-up in one step as taught by the method of this invention.

What is claimed is:

1. A directional shield member for use in simultaneously applying and blending at least one spray or pigmented cosmetic in one step, which produces a gradient in the amount of at least one pigmented cosmetic on the skin, the directional shield member comprising:

a directional shield for defining a skin surface area upon which the pigmented cosmetics are deposited, disposed between at least one spray of pigmented cosmetic and the skin surface area upon which the pigmented cosmetics are to be deposited, and at least one stencil wall for directing the spray of at least one pigmented cosmetic to produce the gradient.

2. The directional shield member according to claim 1, further comprising a wedge-shaped flange, which promotes eyelid closure when the directional shield member is used in the application of eye make-up.

3. The directional shield member according to claim 1, wherein the directional shield member has a resilient edge.

4. The directional shield member according to claim 1, wherein the directional shield member is removable and interchangeable with at least one other directional shield member having an alternative configuration.

5. The directional shield member according to claim 1, wherein at least one stencil wall is removable and interchangeable with at least one other stencil wall having an alternative configuration.

6. The directional shield member according to claim 1, wherein at least one stencil wall is located within the directional shield and divides the directional shield into a plurality of sections.

7. The directional shield member according to claim 6, wherein at least one stencil wall may be removed and replaced in another position within the directional shield.

8. The directional shield member according to claim 1, further comprising:

a stencil attached to or within directional shield for further defining the skin surface area upon which the pigmented cosmetics are deposited.

9. The directional shield member according to claim 8, wherein the stencil is removable and interchangeable with at least one other stencil having an alternative configuration.

10. The directional shield member attached to an applicator section according to claim 9, wherein the pressure of the pressurized air ranges from 10 p.s.i. to 50 p.s.i.

11. The directional shield member according to claim 8, wherein at least one stencil wall is attached to the stencil to form a stencil/stencil wall unit.

12. The directional shield member according to claim 11, wherein the stencil/stencil wall unit is removable and interchangeable with at least one other stencil/stencil wall unit having an alternative configuration.

13. The directional shield member according to claim 1, wherein the directional shield member is attached to an applicator section, the application section comprising:

at least one storage and releasing means for pressurized air;

at least one storage and releasing means containing at least one pigmented cosmetic; and a spraying means for simultaneously releasing together at least one portion of pressurized air and at least one portion of pigmented cosmetic to form at least one spray of pigmented cosmetic.

14. The directional shield member attached to the applicator according to claim 13, wherein there are storage and releasing means for at least two different colors or type of pigmented cosmetics.

15. The directional shield member attached to the applicator section according to claim 13, wherein the storage and releasing means containing pressurized air is the same as the storage and releasing means containing pigmented cosmetics.

16. The directional shield member attached to the applicator section according to claim 13, wherein the pressure of the pressurized air ranges from 20 p.s.i. to 40 p.s.i.

17. The directional shield member attached to the applicator section according to claim 13, wherein the storage and releasing means are removable and interchangeable with other storage and releasing means.

18. The directional shield member of claim 1, wherein the directional shield member is attached to an applicator section, the applicator section comprising:

a container holding a pressurized air supply and having a discharge port for the pressurized air supply;

a conduit means connected to the discharge port, extending from the container and terminating in a spray orifice;

a valve means to control the flow of the pressurized air through the spray orifice;

an actuator means connected to the valve means;

a holding means attached to the container and so disposed that the pressurized air exiting from the spray orifice passes through and exits from the holding means;

at least one storage and releasing means for containing at least one pigmented cosmetic, so disposed within the holding means that the pressurized air exiting from the spray orifice and passing through the holding means also passes by and past the storage and releasing means; and at least one pigmented cosmetic contained within the storage and releasing means so formulated and so suspended within the storage and releasing means at as the pressurized air exits from the spray orifices and passes through the holding means and past the storage and releasing means, the pressurized air contacts the pigmented cosmetic thereby atomizing a portion of the pigmented cosmetic, which the exit from the storing and releasing means along with the pressurized air.

19. The directional shield member attached to the applicator section according to claim 18, wherein the spray orifice has square configuration.

20. The directional shield member attached to the applicator section according to claim 18, wherein the applicator section has a plurality of storage and releasing means for containing pigmented cosmetics, and wherein the conduit means is sufficiently divided to provide a plurality of spray orifices in equal number to the number of storage and releasing means for containing pigmented cosmetics, thereby providing that separate jets pressurized air pass each storage and releasing means.

21. The directional shield member according to claim 1, wherein the directional shield member is attached to an applicator section, the applicator section comprising:

a container having at least one chamber, containing a mixture of pressurized air and pigmented cosmetic and having a discharge port;

at least one valve means to control and direct the flow of portions of the mixture of pressurized air and pigmented cosmetic as it exits from the discharge ports;

an actuator means connected to the valve means; and at least one conduit means, connected to the discharge port and terminating is a spray orifice.

22. The directional shield member attached to the applicator section according to claim 21, wherein the spray orifice has a square configuration.

23. The directional shield member attached to the applicator section according to claim 21, wherein the applicator section has a plurality of chambers containing mixtures of pressurized air and pigmented cosmetics;

a plurality of discharge ports; and a plurality of conduit means, the chambers, the discharge ports, and the conduit means being in equal number to each other.

24. The directional shield member attached to the applicator section according to claim 21, wherein the container can pivot relative to the conduit means, permitting each conduit means to connect with a different discharge port depending on the position of the container.

25. A method for simultaneously applying and blending pigmented cosmetics in one step, which produces a gradient in the amount of at least one pigmented cosmetic on the skin, using an applicator which comprises:

at least one storage and releasing means containing pressurized air;

at least on storage and releasing means containing at least one pigmented cosmetic;

a spraying means for simultaneously releasing together at least one portion of pressurized air and at least one portion of pigmented cosmetic to form at least one spray of pigmented cosmetic;

a directional shield member for defining a skin surface area upon which the pigmented cosmetic are deposited, disposed between at least one spray of pigmented cosmetic and the skin surface area upon which the pigmented cosmetics are to be deposited;

at least one stencil wall for directing the spray of at least one pigmented cosmetic to produce the gradient.

* * * * *